United States Patent [19]

Wilkening et al.

[11] 4,102,170

[45] Jul. 25, 1978

[54] METHOD FOR MAKING A SPIRAL COIL HAVING SPACED TURNS

[75] Inventors: Hermann Wilkening, Dusseldorf-Kaiserswerth; Hans-Joachim Loges, Dusseldorf, both of Germany

[73] Assignee: IOG Industrie-Ofenbau GmbH, Dusseldorf, Germany

[21] Appl. No.: 692,430

[22] Filed: Jun. 3, 1976

[30] Foreign Application Priority Data

Jun. 4, 1975 [DE] Fed. Rep. of Germany ..... 2524763

[51] Int. Cl.$^2$ ..... B21C 47/04

[52] U.S. Cl. ..... 72/147

[58] Field of Search ..... 72/146, 147, 148, 196; 242/1

[56] References Cited

U.S. PATENT DOCUMENTS

| | | | |
|---|---|---|---|
| 2,257,760 | 10/1941 | Nyberg | 72/147 |
| 2,275,458 | 3/1942 | Nyberg | 242/1 |
| 3,557,592 | 1/1971 | Corns | 72/146 |
| 3,581,389 | 6/1971 | Mori et al. | 72/147 X |
| 3,966,646 | 6/1976 | Noakes et al. | 72/147 X |

FOREIGN PATENT DOCUMENTS

| | | | |
|---|---|---|---|
| 2,015,100 | 11/1971 | Fed. Rep. of Germany | 72/146 |
| 2,054,595 | 5/1972 | Fed. Rep. of Germany. | |

*Primary Examiner*—E. M. Combs

*Attorney, Agent, or Firm*—Berman, Aisenberg & Platt

[57] ABSTRACT

A method for winding a spiral coil involving the steps of winding a metal band on a mandrel in advance of the mandrel continuously forming a succession of regularly-spaced deformations in the band edges which protrude alternately from the opposite band surfaces to space the coil turns. During the winding, and for each successive turn, the sequence of deformations is shifted along the band, in one direction or the opposite, by a predetermined dimension such that oppositely-protruding deformation on adjacent turns come into tangential locking engagement with each other at the start of every succeeding turn and all projections on each turn come into such locking engagement. Apparatus for performing the method is also disclosed.

19 Claims, 24 Drawing Figures

$F_1$
$F_2$
a
2a
b
h
s
d
A
101
102
2
3
$2\Delta U = 2(2\pi \cdot \Delta r) = 4\pi(h+s)$
$2\Delta U$ 2
3
1
t
22
301
201
d 15
16
k
k'
4
m'
m
41
9
9'
5
51
e'
e
f
f'
6
61
1
14
22
20
19

1
t
3
Z
2
R
22
t
141
50
d
M
14
0,5 M1
0,5M2
3
2
511
521
52
512

14
14
1
22
512
3
3
511
52
521
50
0,5M1
0,5M2
M0

METHOD FOR MAKING A SPIRAL COIL HAVING SPACED TURNS

FIELD OF THE INVENTION

This invention relates to a method for making a coil from a band which is wound with winding intervals or spacings between turns and whose band edges reveal a sequence of regularly-recurring, locally-limited deformations that protrude out of both band surfaces to determine the interval or space between neighboring turns, the deformations being shifted with each turn so as to lockingly engage all oppositely-protruding deformations of adjacent turns in a tangential direction.

In the following description and throughout the specification and claims, the terms listed below are defined as follows:

"Winding" means a single turn or convolution;

"Interval" means distance, space or spacing;

"Composite thrust" means that that force preventing the free displacement of the turns of the coil parallel to each other; this force may be due to friction or to form-locking by interlocking engagement of turn deformations;

"Composite material diameter" means the diameter of the coil comprising the gauge thickness of the band plus spaces between turns;

"Compound thrust" means the same as "composite thrust".

DESCRIPTION OF THE PRIOR ART

It is known that, by punching the edges of a belt in the immediate edge area, one can produce edge deformations either in every other turn or continually in all turns and, that the depth of these edge formations, will fix the spacing between adjacent turns, whereby the composite thrust is engendered from winding to winding exclusively by the friction between the edge deformations and the neighboring turns.

In order to become independent of the friction and in order to increase the composite thrust of neighboring turns, for the purpose of achieving an even greater composite material diameter at maximum width and thus correspondingly greater composite material weights, it is known that one can, with a tool working in a rotating manner, produce two types of edge deformations in a deep-drawing manner, one of which serves only as an individual half-wave oriented toward one surface primarily to ensure the maintenance of the winding intervals, while the other one has sinusoidal double-half-waves oriented toward both band surfaces, see U.S. Pat. No. 3,724,249 for example. The individual half-waves of the double-half-waves are oppositely oriented and are connected so that, in addition to ensuring the turn spacing, they function to bring about the compound thrust of neighboring windings in a form-locking manner in the direction of winding.

Because these two connected sinusoidal half-waves, oriented toward both band surfaces, are lockingly engaged in the outer areas of the half-waves at adjacent coil turns, correspondingly larger working diameters of the drawing tools used to form the deformations are needed. Compared to the production of individual half-waves, the production of both immediately-successive sinusoidal half-waves, each with the same magnitude, requires the working diameter of the tool to be four times as great.

In addition there is the fact that, in forming the known sinusoidal double-half-waves, for every turn in the coil the winding jump $\Delta r$ which equals the increase in coil radius from turn to turn must be inserted, where:

$\Delta r = h + s$ $h$ = band thickness $s$ = turn spacing

For example, in case of a change in the band thickness $h$ and in the constantly-selected turn spacings, the matrix-upper die pairs for the production of sinusoidal double-half waves must be changed to produce correspondingly-altered oscillation widths because, along with the change in the shift of the identical band-edge deformations in neighboring windings, which is proportional to the change in $\Delta r$, it is also necessary to change the interval of the two differently-oriented sinusoidal half-waves in order to achieve the compound thrust form of the neighboring windings in a form-locking manner.

If the tool is not adjusted to a change in $\Delta r$, then the thrust compound unit of neighboring windings of course exists only in a force-locking manner due to all edge deformations, whereby, as the compound material diameter increases, there is a danger of a followup slide particularly on the part of the windings that are located furthest toward the inside, with a corresponding decrease in their winding intervals.

Only in case of larger band thicknesses and/or winding intervals, does the winding jump $\Delta r$ and thus the length difference of neighboring windings $\Delta U = 2\pi \cdot \Delta r$ becomes so great that the sinusoidal double-half-wave deteriorates into two individual half-waves with sufficient space in between where each wave is produced by itself with separate upper-die-matrix pairs.

In a known metal band (U.S. Pat. No. 2,275,458), the interval between the edge deformations is not particularly specified so that there is a danger that the deformation of a following winding will run up and align with the deformation of the preceding winding and, depending upon which band surface the latter protrudes from, it will then seat into this deformation so that the free space between windings will not be maintained, or it will align with the former so that the free space in this area will be enlarged. Above all there is a danger that the individual windings will slide up on top of each other because the band will be under traction stress during reeling up. This leads to damage to the band surface. After completion of the windup of the coil, the latter cannot be freely deposited and stored with a horizontally-positioned axis because the individual windings would then again be shifted against each other. It is therefore necessary first of all to tip over such coils so as to line up their axes in vertical directions. This implies an additional effort in terms of labor and equipment and thus also costs.

In another known metal band (German Pat. Laid Open to Inspection No. 2,054,595 and corresponding U.S. Pat. No. 3,724,249), separate tool pair is proposed for the production of a continuous, angle-like bending of the band edges. This bending of the band edges brings about a multiplication of their bending strength resistance and thus a considerable increase in the inherent rigidity of coils wound up from such band, and the weight of those coils, when stored with the axis running horizontally, rests exclusively on the two side discs.

SUMMARY OF THE INVENTION

The purpose of this invention is to create a method for making coils which provides for greater band thicknesses and/or winding interval ranges, as well as apparatus for the simultaneous production of the band edge deformations and the sequence of locally-limited deformations in the edge areas of metal bands, or strips, with which, during the reel-up of such metal bands between the first winding and the winch reel, as well as between the neighboring windings for the most part in the direction of winding and partly against the direction of winding, as well as in the axial direction, there will be achieved a form-locking thrust composite as prerequisite for winding with countertraction or back traction of a band start which is placed around the winch with the help of a belt winder, without clamping the band, thus yielding coils with a great inherent rigidity.

This problem is solved in the following manner according to the invention: the sequence of local band edge deformations, oriented toward opposite band surfaces, is a sequence given by the succession of matrices and upper dies on the circumferences of tool carrier wheels, and these local band edge deformations, progressively with each winding, are shifted by a dimension $c_1$ in the direction of band movement, or a dimension $c_2$ against the band movement direction, said dimensions considering the tool subdivision interval $t$ and the winding jump (increase of coil radius from one turn to the next) deriving from band thickness $h$ and winding interval $s$, as compared to the local band edge deformations of the preceding winding.

Due to these relative shifts in the sequence of belt edge deformations by the dimension $c_1$, or $c_2$, of successive windings, it is made certain that all band edge deformations, oriented toward the winding mandrel of the particular oncoming winding will be hooked or locked, in starting the turn or winding at the initial contact point with the oppositely-oriented band edge deformations of the preceding winding.

The space between the tool and the winch shaft plays no role here even if that space were to assume the magnitude of the circumference of the largest winding because, between the lengths of coil windings, there is a difference of only a few millimeters and because after every rotation of the winch shaft, the band length for at least the next winding is present in a distorted fashion between the initial contact point and the tool in the edge areas. A minor overlap of band material with edge deformations in the incorrect orientation during the shifting of the sequence of band edge deformations at the end of each run-up winding in one step can be permitted.

By the shift of deformations as described, it is ensured that the individual windings will be held so that they cannot shift with respect to each other and that, even after the coil is removed from the winch and placed on a foundation surface with its axis horizonal, the coil will remain standing in a rigid shape so that there cannot be any damage to the band surfaces at any time or in any position.

Due to the resultant thrust composite of neighboring windings they are prevented from sliding with great certainty even under considerable countertraction.

Coils wound according to the invention can be subjected to the most varied treatments, such as, for example, a blanching, washing, or rinsing procedure, an electrolytic coating procedure, an annealing procedure, a cooling procedure, a steaming procedure, or combinations thereof. Due to their great inherent rigidity and their great standup capacity, these openly-wound coils can also be rewound, transported, and placed in intermediate storage with their axes in the horizontal direction.

According to one preferred embodiment, the shifting of the sequence of band-edge deformation, uniformly distributed over the circumference of the particular newly oncoming winding, by the dimension $c_1$ in the direction of band movement, or, by the dimension $c_2$ against the band movement direction, is generated by a continual positive or negative superposition of the amount of tool rotation.

According to another embodiment, the overall shift of the sequence of band edge deformations, to be matched up with the particular oncoming winding, by the dimension $c_1$ or the dimension $c_2$, is generated by a corresponding positive or negative superposition of the amount of tool rotation in one step.

According to yet another embodiment, the entire shift of the sequence of band-edge deformations by the dimension $c_1$ in the direction of band movement, or by the dimension $c_2$ against the band movement direction, is accomplished by the action, alternating from winding to winding of two identical tool-carrier wheel pairs which are arranged one after the other in the band movement direction and which run synchronously with each other and with the band movement speed, and whose mutual axial interval or spacing can be continually changed during operation.

The command to employ one or the other tool pair, as a time function of the alternating direction (close forward tool pair, open rear tool pair, and vice versa), the band speed, and the spacing of the tool pairs is so given that no band portions without local edge deformations will be left.

According to another embodiment, the shift of the sequence of band edge deformations by the dimension $c_1$ in the band movement direction, or by the dimension $c_2$ against the band movement direction, is always accomplished at the same angle position in the coil.

For certain band thickness ranges and coil dimensions, it may be required, with respect to the standup capacity of the band rings during storage with their axes running horizontally, that, for the purpose of distribution of the overlap sectors of the band material of neighboring windings, with the inadequate form-locking thrust security which is possible, the shift of the sequence of the band-edge deformations by the dimension $c_1$, or by the dimension $c_2$, will be generated in a manner distributed over several angle positions in the coil.

According to still another embodiment of the invention it is provided that the number of the band edge deformations, oriented toward the upper and the lower band surface, and their mutual interval should be equally large. This ensures that, following the corresponding shift of the sequence of band-edge deformations, each outwardly oriented deformation of the last turn will be hooked up with the corresponding inward deformation of the just oncoming turn at the run-up point of the winding in a form-locking manner in the direction of windup and will simultaneously fix the winding interval at this point.

The number of band-edge deformations, oriented toward the upper and lower band surface, can be equal and their mutual spacing can be identical, or unequal.

In this arrangement of the edge deformations likewise, it can be ensured that, after the corresponding shift of the sequence of band-edge deformations, the outwardly-oriented band edge deformations of the just oncoming winding will be hooked in with the corresponding inward deformations of the oncoming windings in the direction of windup in a form-locking manner, and simultaneously, like all other band-edge deformations, their depth will fix the winding interval at their points of engagement.

The remaining inwardly oriented band-edge deformations furthermore, at their points, via their friction in relation to the neighoring windings, make a contribution to the thrust composite of neighboring windings both in the windup direction and against the windup direction.

According to another feature of the invention, the thrust composite of neighboring windings develops in a form-locking manner, also in the direction of the windup axis, due to band-edge deformations which are located diagonally with respect to their band edges and which, together with the band-edge deformations in the area of the other band edge, produce an arrow-shaped arrangement.

In order to limit the necessary additional expenditure for the more complicated, screw-shaped design of the matrices and upper dies, it is enough in many cases to design and arrange only a part of the matrices and upper dies on the tool carrier wheels in the area of both band edges in such a way that, for the purpose of creating an arrow-shaped arrangement which will secure the thrust composite also in the axial direction in a form-locking manner, only a part of the band-edge deformations in the area of both band edges will be arranged diagonally with respect to their band edges.

The arrangement of the band edge deformations at an angle with respect to their band edges can be omitted if, before the local deformation of the band edges in terms of time, fine-toothed grooves are located in the longitudinal direction of the band or at a slant with respect to their band edges, in the most immediate band edge area.

In order to balance out the polygonizing effect deviations of the windings from their circular shape, due to the only point-shaped bracing of the windings, taking place at certain intervals, and the attendant of the winding lengths, as well as the influence of the elastic lowering of the windings, pointing in the same direction, due to the point stresses from the superposed windings, it is provided, according to another feature of the invention, that the winding intervals or turn spacings are changed as a function of the windup radius. The corresponding change in the deformation depth of the band-edge deformations can here be brought about during operation through a change in the adjustment of the tool carrier wheels and/or the positioning of the upper dies in the tool carrier wheels.

In case of certain band dimensions and/or coil weights, it may be necessary to increase the standup capability of such coils which are stored with the axis running horizontally, by supporting the thrust composite of the neighboring windings, supported only by friction or in a force-locking manner against the windup direction, through edge deformations which, added at individual points, will in a form-locking manner secure the thrust composite against the windup direction.

For this purpose, after the accomplishment of the shift in the sequence of band-edge deformations, in one step by the dimension $c_1$, or by the dimension $c_2$, at one point in each winding, practicably in each case after half a turn has been made, one additional rotation amount of the tool is performed for a short time and then taken back or subtracted, as by increasing the speed of rotation of the tool and then decreasing the speed to normal, in order to accomplish the form-locking hook-in of neighboring windings at some points against the windup direction.

In case of a shift of the band-edge deformation sequence, distributed uniformly over the winding circumference, the short-time additional rotation imparted to the tool and its return may be accomplished at any desired point in each winding.

The superposition of the rotation movement imparted to the tool according to this method can, for example, be accomplished with a known planetary gear or with a correspondingly-controlled electric or hydraulic drive motor. In order to connect the last winding of the coil with the composite coil unit firmly but nevertheless easily separable, without any tie-up means, such as, for example, a packaging tape, it is proposed according to the invention that the shift of the sequence of edge deformations in or against the band movement direction in the band material be generated for at least the last winding in such a magnitude which, in combination with the greater curvature imparted to this winding shortly before windup completion, this is, a curvature greater than would correspond to its position in the wound-up coil and its resultant elastic encompassing clamping, will assure the hook-up of its corresponding band edge deformations with those of the particular preceding winding against the windup direction.

The invention also comprises a device for the accomplishment of the method according to the invention whereby — for the production of the local deformations which act in a form-locking manner, which ensure that the band interval, and which are found in the edge sectors of the band in the area of both band edges, there are provided mutually synchronously rotating tool carrier wheel pairs on whose circumferences are mounted the matrixes and upper dies for the local deformation of the edge areas of the band.

According to another feature of the invention it is provided that the number of matrixes and upper dies be equal in the corresponding tool carrier wheels, that their mutual interval be equal or unequal, and that, in terms of their arrangement, the matrix and the upper die follow each other on the circumferences of the tool carrier wheels.

According to another feature of the invention, the number of matrixes and upper dies in corresponding tool carrier wheels can be uneven and their mutual interval can for the most part be identical but, for the remaining part, it can be unequal.

In the device according to the invention for the production of the local deformations in the band's edge areas, deformations which act in a form-locking manner, the uniform distribution of the shifts of the sequence of band edge deformations over the entire winding circumference by the dimension $c_1$ in the direction of belt movement, or by the dimension $c_2$ against the band movement direction, is accomplished through a continual rotation path superposition of the tool carrier wheel pairs in such a manner that, for each winch revolution, an additional amount of rotation is superposed upon the tool rotation required for said revolution and said additional amount of rotation can be adjusted as desired during operation.

In another embodiment of the invention for the production of the form-locking-acting local deformations in the edge areas of the band, it is provided that the shift in the sequence of band-edge deformations by the dimension $c_1$ or $c_2$ is achieved at the end of each run-up winding, or at any desired point of the up-running winding through a short-time superposition of the rotation movement of the tool carrier wheels by a certain positive or negative rotation angle $\beta$ which can continually be changed during operation.

Because of their compact design, the machines of the invention are particularly suitable where space must be saved, for example, at the outlet of a cold-rolling mill, in order to provide the finished rolled band with a passage in front of the windup winch to form the edge deformations to achieve the winding intervals in the wound-up coil on the windup winch.

The shift of the sequence of band edge deformations by the dimension $c_1$ or $c_2$, according to the invention, is accomplished by means of a superposition of the rotation movements of the tool carrier wheels, adapted to the band movement speed, through the use of a planetary gear or through a correspondingly controlled electrical or hydraulic drive motor.

In another embodiment of the apparatus according to the invention, the continual rotation path superposition of the tool is brought about by means of a worm gear drive acting upon the outside wheel of a planetary gear.

In still another embodiment of the invention, it is possible, by a corresponding axial shift of a cylindrical worm gear, for example, by means of a hydraulic piston, to superpose, in one step, an additional negative or positive rotation of the tool, using a worm gear drive.

The tool carrier wheels are preferably equipped with a freely rotating, elastically embedded downholder disc with separate drive. Between an upper and a lower downholder disc, whose circumferential speed corresponds to the band movement speed, the band is conducted steadily, while the outermost band edge areas, in which the sequence of local band edge deformations is produced, are in contact with the tool carrier wheels essentially only in the area of the matrixes and the upper dies.

According to another embodiment of the invention the downholder discs are so designed that their band-edge area is bent at an angle.

The tool carrier wheels are elastically connected with their drive to compensate for the minor differences between the band movement speed and the circumferential speed of the matrixes and upper dies on the circumferences of the tool carrier wheels which, in each case through the engagement of matrix and upper die, assume the movement speed of the band.

According to another embodiment of the invention, for the production of edge deformations which act in a form-locking manner, there are provided, in the area of each band edge, two tool carrier wheel pairs which are arranged one after the other and which run synchronously with respect to each other.

The shift of the sequence of the succession of band edge deformations at the end of each run-up winding, given by the particular tool carrier wheel pair in working position, is accomplished by closing the open tool carrier wheel pair and by opening the tool carrier wheel pair which happens to be in working position. This enables taking into consideration the alternating direction of movement in band passage direction from the rear to the forward tool carrier wheel pair and the other way around, as well as the band speed, in the time sequence of the adjustment commands for both tool carrier wheel pairs, and further enables changing the reciprocal position of corresponding edge deformations in neighboring windings by altering the reciprocal interval of the tool carrier wheel pair continually during operation.

The adjustment command for starting the shift of the sequence of edge deformations is triggered by a signal revolving with the winch shaft.

According to another embodiment, the adjustment command is always given when the winch shaft is in the same angle position. For certain band thickness ranges and coil dimensions, it may be necessary to delay the onset of this shift in terms of time somewhat as compared to the triggering in the case of the preceding winding, and this is to be done by means of a delaying member in the command chain from the signal member, revolving with the winch shaft, up to the activating member used in shifting the succession of edge deformations. In this way can be achieved the following: the overlap area of the band material of the neighboring windings is further rotated by a small angle, progressing always from winding to winding, with the inadequately form-locking thrust which is possible there, so that a form-locking thrust for neighboring windings will be obtained which will be extensively homogeneous over the entire coil.

Between the upper and the lower tool carrier wheel of a tool carrier wheel pair it is necessary to establish an maintain exact synchronization. In the adaptation of the axial intervals of the tool carrier wheels of a tool carrier pair to the differing band thicknesses and/or differing depressions of the edge deformations, the exact synchronization between the upper and the lower tool carrier wheel takes place by use of a grooved roller gear and driven end of shaft output spindles with identical, unchanging inclination angles with respect to their band edge.

Because the adjusting paths of the tool carrier wheels, for the purpose of adaptation to differing band thicknesses and/or differing depressions in the edge deformations, amount only to a few millimeters, a tool carrier wheel pair may be selected in which, with unchanging axial interval, during operation, the necessary changes in the adjustment of the tools is accomplished by radial adjustment of the upper dies in the tool carrier wheels. This solution, with its internal change of the adjustment, is advantageous when it is important to save space.

According to another embodiment, for the production of edge deformations which act in a form-locking manner, a tool carrier wheel pair may be selected in which, in case of an unchangeable axial interval, the necessary changes in the adjustment of the tools, for different band thicknesses and different depths of the edge deformations, is achieved by swinging a tool carrier wheel with its axis around the center of a gear wheel which, with an identical gear wheel, establishes the forced synchronization of both tool carrier wheels, the former gear wheel having spherically shaped gear rim outside surfaces and teeth.

According to another embodiment for the production of edge deformations acting in a form-locking manner, the tool carrier wheels in the running plane of the matrices and upper dies, receive elastically embedded downholder rings which, during the adjustment of the tool carrier wheels for production of edge deformations which protrude even more from the band surface, using the same tool, allow the upper dies to protrude correspondingly further out of the running plane, so that the upper dies, in cooperation with the matrices, will produce correspondingly more deeply impressed edge deformations.

For the production of edge deformation in bands of great thickness, including a greater range of thickness, with the same tool, matrixes which are elastically supported in a tangential direction and which automatically adjust to the greater band thickness through opening against an elastic closing force are used.

In order to provide unbordered bands, having width fluctuations with edge deformations whose spacing from their band edges will not change, it is proposed that the axes of the tool carrier wheels on both sides of the band be made to swing independently of each other by a small angle in the band plane, so that the tool carrier wheels can follow the width change of the band on both sides independently of each other without generating a force which would cause the band to bulge, arch, or tighten in a lateral direction.

To reel up the band provided with edge deformations on a smooth winch shaft without clamping the start of the band in a winch clamping slit, it is suggested that the winch shaft be provided with carrying bars that can be moved in a radial direction, and according to the invention this winch shaft is so designed that, on a driven carrying pipe, for the purpose of form-locking tansmission of the carrying pipe circumferential force from the winding moment into the first band winding, there are arranged radially adjustable carrying bars which brace the coil and which are located at least in the space contiguous to the deformations of the band edges, and are oriented toward the carrying pipe, so as to permit adjustment to differing band thicknesses. Upon completion of the winding process, these carrying bars are taken back radially so as to permit the coil to be pushed off the carrying pipe.

Since the band thickness differences usually amount to only a few millimeters, the winch shaft must cover only a minor adjustable spread range so that even traditional winch shaft constructions having adjustable windup diameters and superposed carrying bars can be used.

Because the coil weight rests in the coil side discs, it is possible to design the reel-up winch as a double-cone winch having a common drive motor and carrying bars with or without clamping slits.

To prevent slippage of the first winding in the axial direction, the carrying bars are provided on their forward edges, those lying in the direction of windup, with sawtooth-like recesses. In case of large coil diameters and/or large band conteraction, it may be necessary for a part of the coil winding moment, which grows with the windup radius, to be applied by means of a coil edge drive.

According to one embodiment of the invention, the drive moment for the coil edge drive is imparted into both band edges in a form-locking manner via a gear wheel or a toothed chain in the plane of the winch shaft moment. According to another embodiment, the drive moment for the coil-edge drive is initiated in both band edges in a force-locking manner via friction wheels having a cylindrical, spherical, or conical generated surface in the plane perpendicular to the band, or at an angle to the plane of the winch shaft moment in the outermost winding area. Naturally the devices for the band-edge drive must adapt to the growing coil diameter.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of specific embodiments when read in connection with the accompanying drawings, wherein like reference characters indicate like parts throughout the several figures, and in which:

DESCRIPTION OF THE PREFERRED EMBODIMENTS

Figure 1:
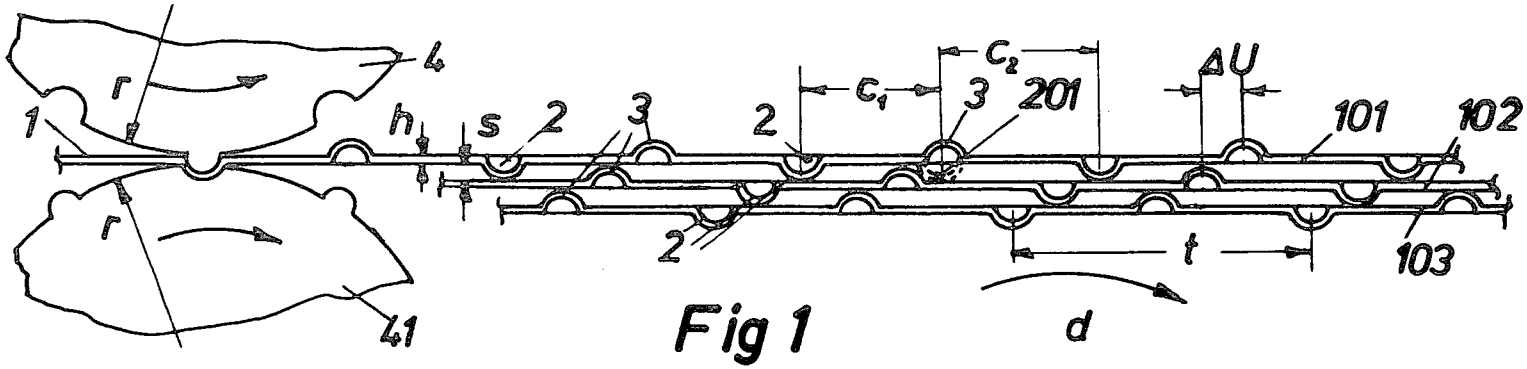
FIG. 1 is an elevational diagram showing parts of a band edge deforming tool and several coil windings with edges deformed in a conventional manner but in stretched-out, uncoiled condition for clarity.

Referring now more particularly to the drawings, FIG. 1 is an illustration of the tool carrier wheel pair 4, 41 used to make the edge deformations 2 and 3 at constant reciprocal interval, said deformations being alternately oriented toward the upper and the lower band surface. As illustrated in the case of windings or turns 101, 102, 103 of band 1, which are drawn in a stretched out, as if unwound, fashion, corresponding edge deformations 2, 3 of neighboring windings during coiling are shifted by the dimension $\Delta U = 2\pi(h + s)$ with respect to each other ($h$ = band thickness, $s$ = winding interval), because of the increasing diameter of the coil.

Only by and after a relative motion of the tool carrier wheel pair 4, 41, with respect to band 1, by the circumferential dimension $c_1$, made at the start of each new oncoming (up-running) winding, can the sequence of the individual edge deformations 2, 3 be shifted by the dimension $c_1$ in the band passage direction, identical to the windup direction $d$, so that the edge deformations 2, oriented toward the lower band surface, will enter into form-locking thrust composite for the windup direction $d$ in the just oncoming winding 101 with the edge deformations 3, oriented toward the upper band surface, of the preceding winding 102. This shift of the sequence of edge deformations 2, 3 is shown by the position of the edge deformation 201 — illustrated with a broken line — which corresponds to the edge deformation 2. It should be noted, from the spacings of deformations 2, 3, 201 in turn 101 as compared to the relative positions of the deformations in turn 102, that the shift $C_1$ in the winding direction equals the space between a downward deformation 2 and next upward deformation 3 plus the increase in turn circumference $\Delta U$ (equal to $2\pi h + 2\pi s$). The shift $C_2$ in the direction opposite the winding direction to gain the same interlocking of deformations 3 and 201 equals the space between deformations 2 and 3 minus $\Delta U$. Thus, as is apparent from FIG. 1, $C_1$ plus $C_2$ equals $t$, the space between consecutive deformations 2.

Figure 2:
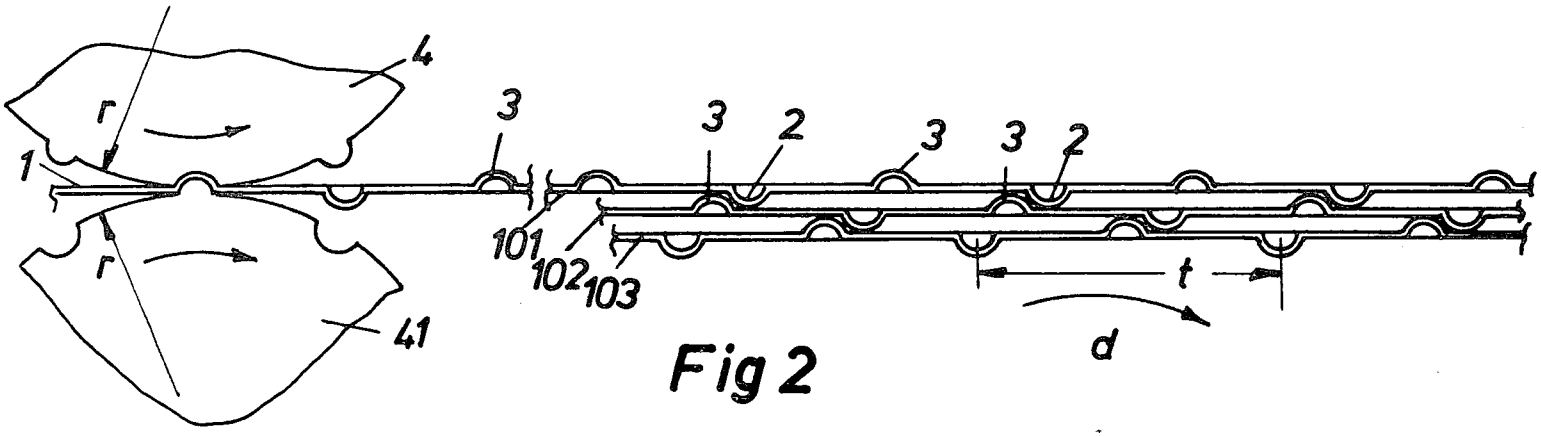
FIG. 2 is a diagram similar to FIG. 1, but with the band deformations shifted in accordance with the invention.

In FIG. 2 is illustrated the point-by-point, form-locking thrust composite of neighboring windings, attained through the said shift $C_1$ of edge deformations 2, 3, for several winding 101, 102, 103 shown uncoiled. The subdivision interval of identical edge deformations is labeled $t$. Note that all deformations projecting toward one another between adjacent turns are tangentially interlocked.

Figure 3:
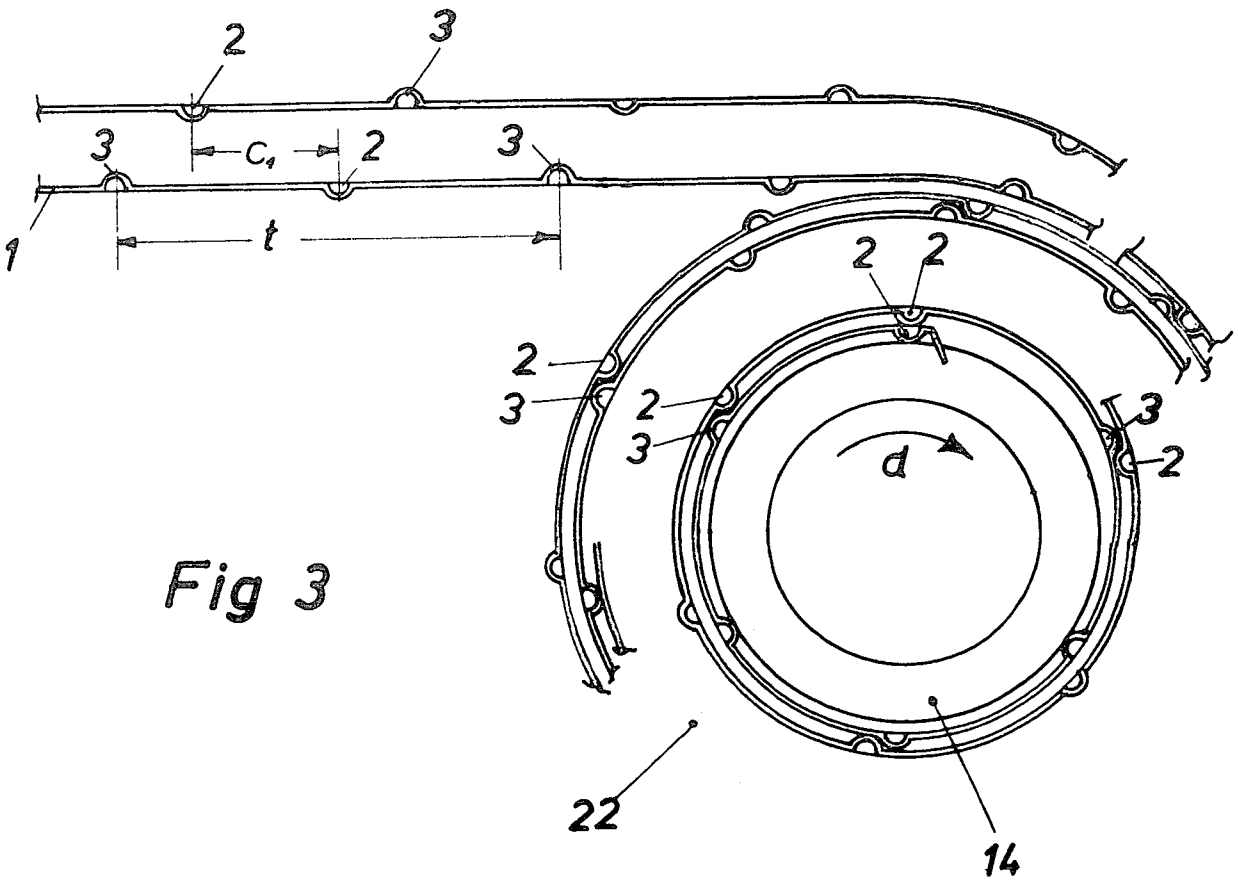
FIG. 3 is an elevational diagram showing parts of a coil wound according to the invention with the outer turns uncoiled to illustrate the shifted band deformations.

In FIG. 3 is illustrated the effect of the shift $c_1$ of the succession of band 1, edge deformations 2, 3 of FIG. 1 and 2 in case of the oncoming (up-running) winding. Only after shift of the edge deformation sequence 2, 3 by the dimension $c_1$ is the oncoming winding of band 1 hooked up with the previously wound up band winding in a point-by-point form-locking thrust composite.

Figures 9, 10:
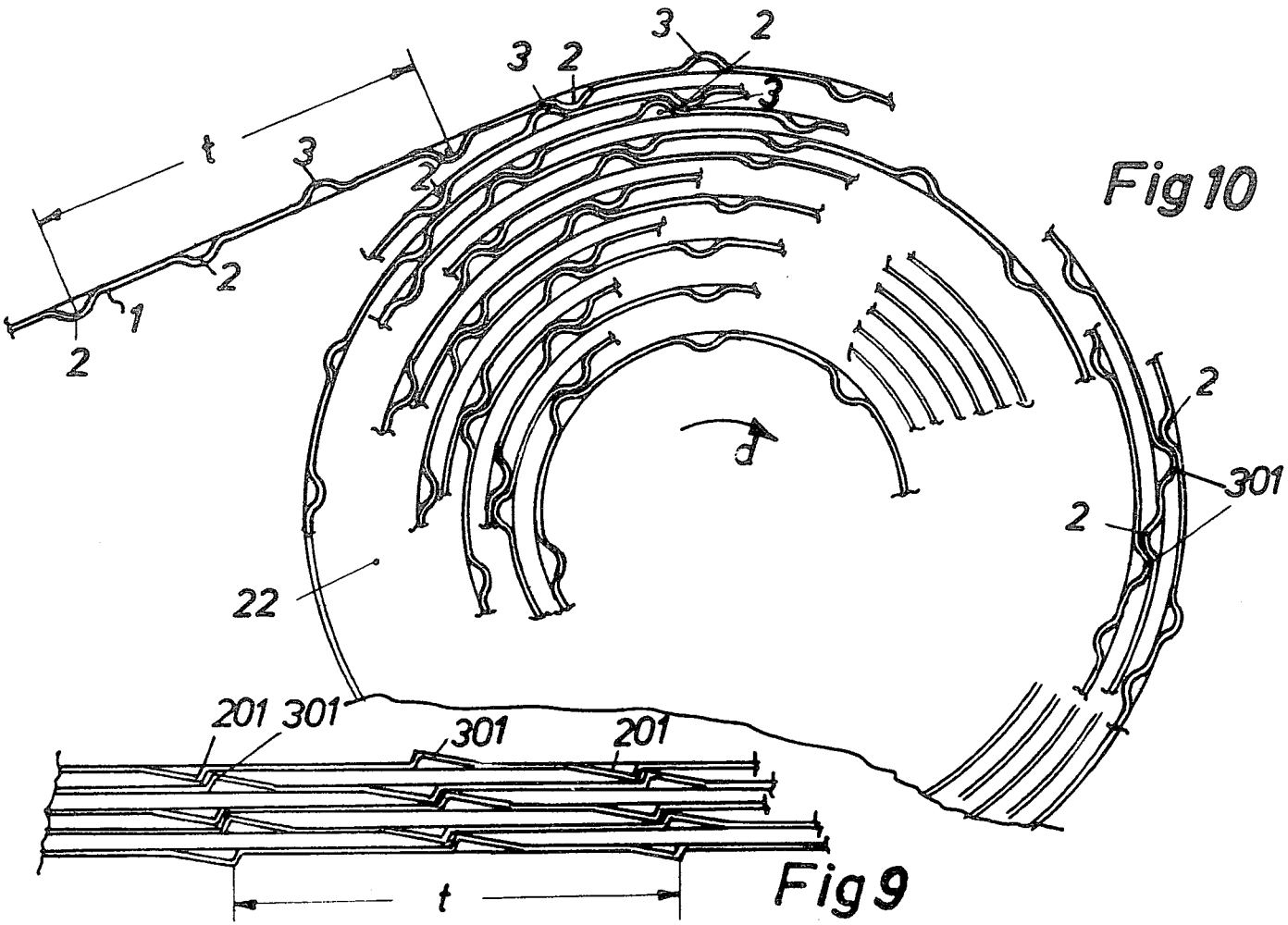
FIG. 9 is a diagram similar to FIG. 8 but illustrating band edge deformations of different shape.
FIG. 10 is a diagram similar to FIG. 3 but utilizing a combination of different band edge deformations, (such as 2, 3 and 2, 301.

According to FIGS. 4, 8, 9 and 10, the thrust composite is achieved in the windup direction $d$ of FIG. 10 (in other words, for the thrust forces $F_1$ in FIG. 4) in a form-locking manner through a combination of band windings 101, 102 which adjoin, or hook or abut, the edge deformations 2 and 3, or 201 and 301, FIG. 9.

Figures 4, 5, 6, 7, 8:
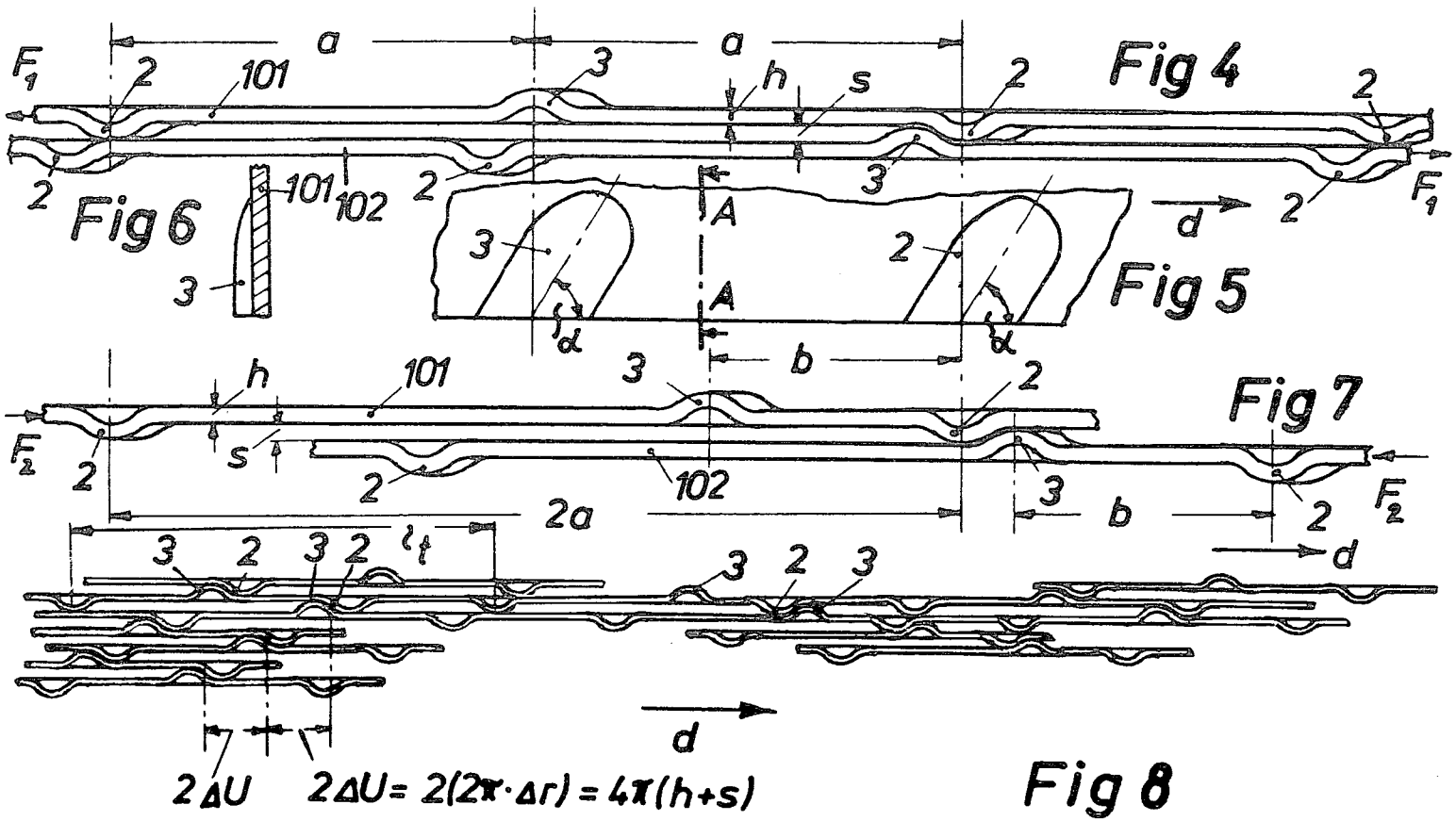
FIG. 4 is an elevational diagram showing two adjacent coil turns with shifted and angled deformations.
FIG. 5 is a fragmentary top plan view of FIG. 4.
FIG. 6 is a crossection taken along line AA in FIG. 5.
FIG. 7 is a diagram similar to FIG. 4 but in which the deformations have been shifted in the opposite direction to provide locking or hookup against the winding direction.
FIG. 8 is an elevational diagram showing several coil turns with band edge deformations shifted in opposite directions so as to provide hookup both in and against the winding direction.

As can be seen from FIG. 5, the edge deformations 2 and 3 (at both band edges) are so inclined toward the band edges at angle $\alpha$ that they will form an arrow-shaped arrangement together with the edge deformations of the opposite band edge not illustrated here, as a result of which the neighboring windings will be connected with each other in a form-locking manner also in their axial direction and therefore cannot slip out in telescope fashion during reel-up and unreeling.

According to FIGS. 7, 8 and 10, the form-locking thrust composite is achieved, against the windup direction $d$ of FIG. 10, for the thrust forces $F_2$, in FIG. 7, with a combination of the lower and upper edge deformations such that the interval $b$ in FIG. 7, between the edge deformations 3 oriented toward the upper band surface and the edge deformations 2, running ahead and oriented toward the lower band surface, is smaller than half of the interval of the two neighboring edge deformations 2, said last interval amounting to half of 2a. Through this emphatic eccentricity of the edge deformation 3, oriented toward the upper band surface, in the particular preceding band winding 102, is created an abutment for the edge deformations 2, oriented toward the lower band surface, in the following band winding 101.

Figure 11:
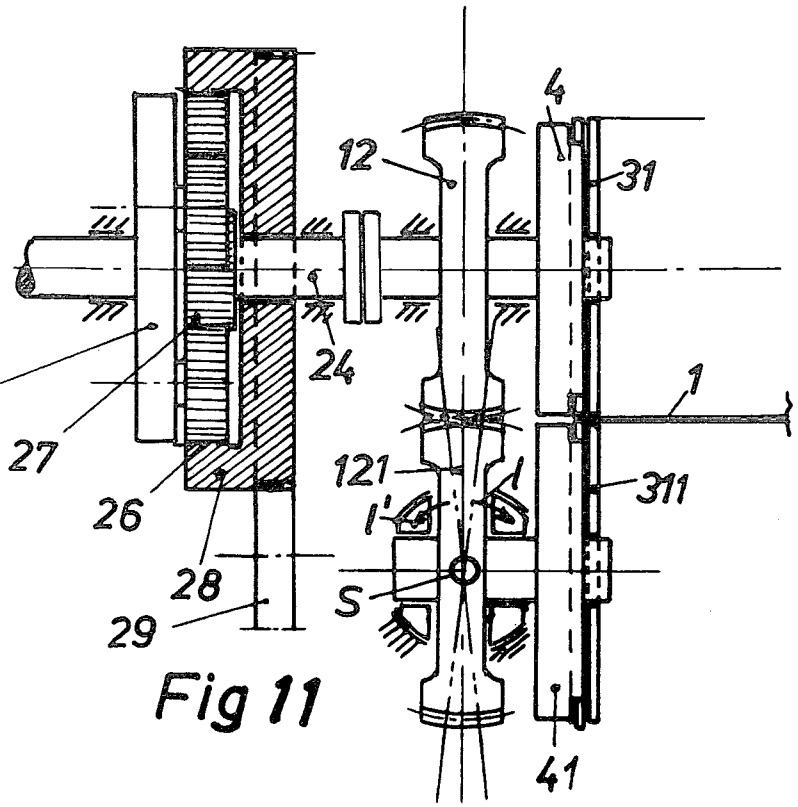
FIG. 11 is an elevation partly in section showing a pair of tool carrier wheels for forming the band edge deformations driven by a planetary gear.
Figure 12:
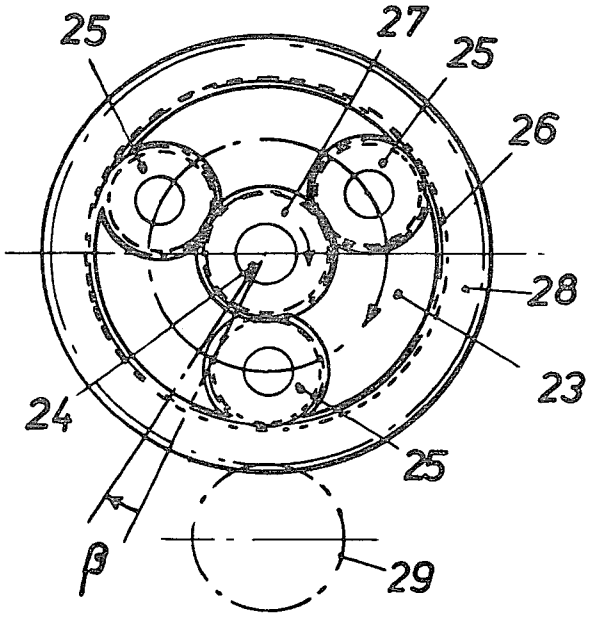
FIG. 12 is an elevation of the planetary gear only taken from the left side of FIG. 11.
Figure 18:
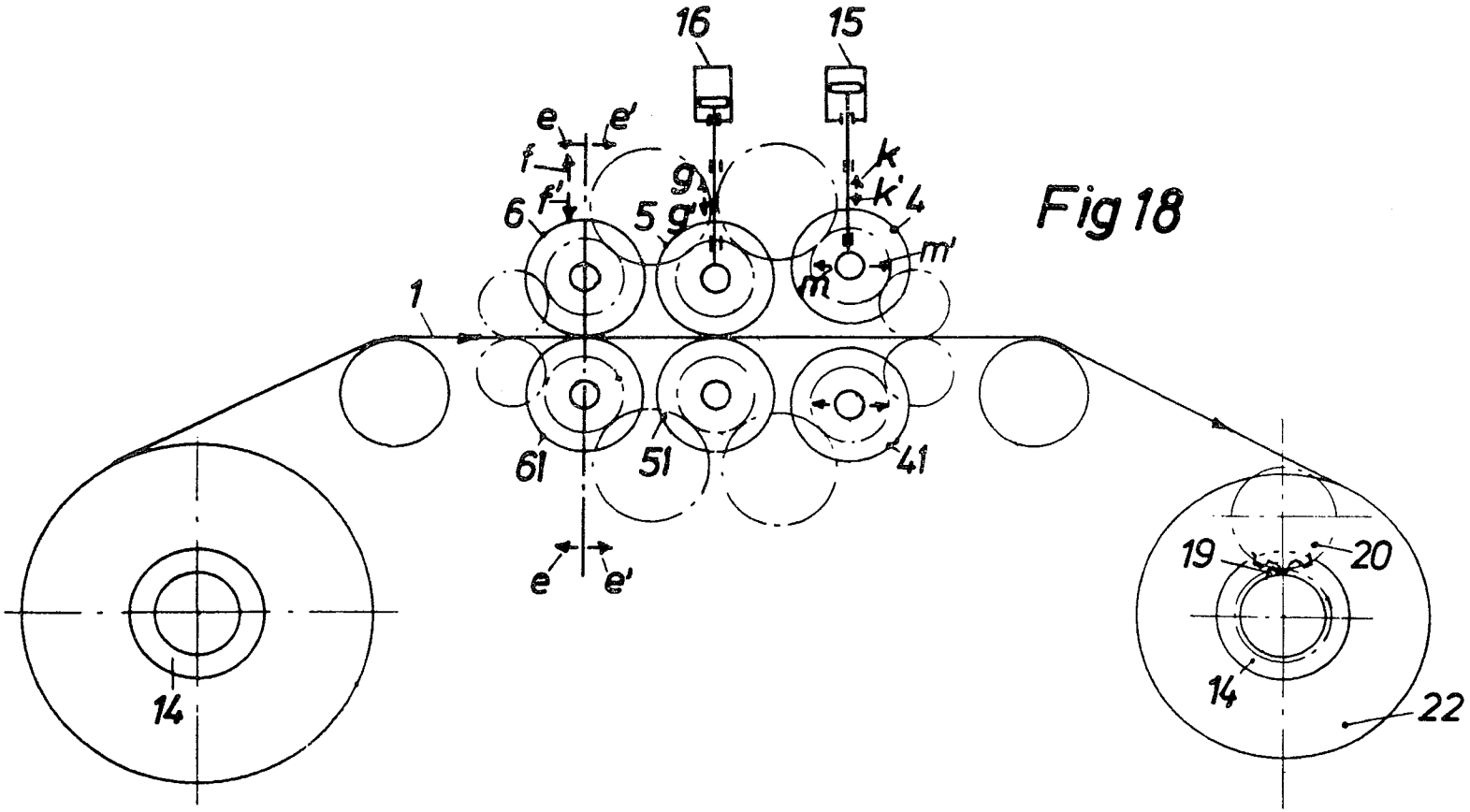
FIG. 18 is an elevational diagram illustrating a preferred version of the system for opening and closing tool wheel pairs.

In FIGS. 11 and 12 is illustrated an edge deformation tool for an edge of band 1; this tool comprises the tool carrier wheel pair 4, 41, the synchronization gear wheels 12, 121, and the main drive, a planetary gear. On the main drive shaft 24 is the sun gear 27, which is driven by planetary gears 25 (which, by their axles, are attached to the driven gear disc 23) as a result of development on the gear wheel 28 which is toothed on the inside at 26. As a result of an additional revolution of tooth wheel 28 (for example, by means of a gear wheel 29 which, upon every revolution of the winch shaft 14 in FIG. 18, is turned further in an abrupt (jerky) manner, or also continually by means of an additional drive which is not illustrated and whose drive transmission can be altered) it is possible to superpose an additional rotation angle $\beta$ on top of the drive rpm shaft 24.

The strap, band 1, is guided by the downholder discs 31, 311 in FIG. 11.

If the teeth of gear wheels 12, 121 are given a spherical shape and if, for example, swing points of tool carrier wheel 41 is placed in the middle of wheel 121, then, by swinging this tool carrier 41 around swing point S in the direction of arrows 1 and 1', the interval of corresponding matrixes and upper dies of the tool carrier wheels 4, 41 and thus the depth of the edge deformation can be altered while retaining the fixed axial interval of the gear wheels 12, 121 which take care of the synchronization between the upper and the lower tool carrier wheels.

Figure 13:
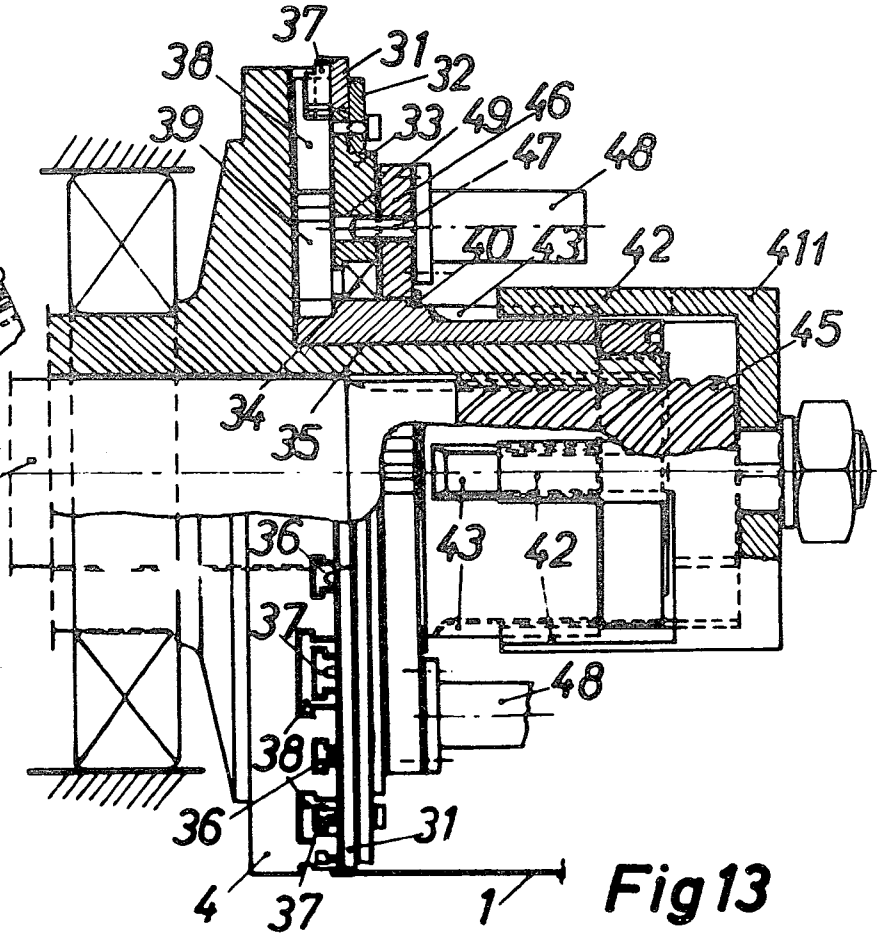
FIG. 13 is an elevational view partly in section showing a single tool carrier wheel having internal means for adjustment.
Figure 14:
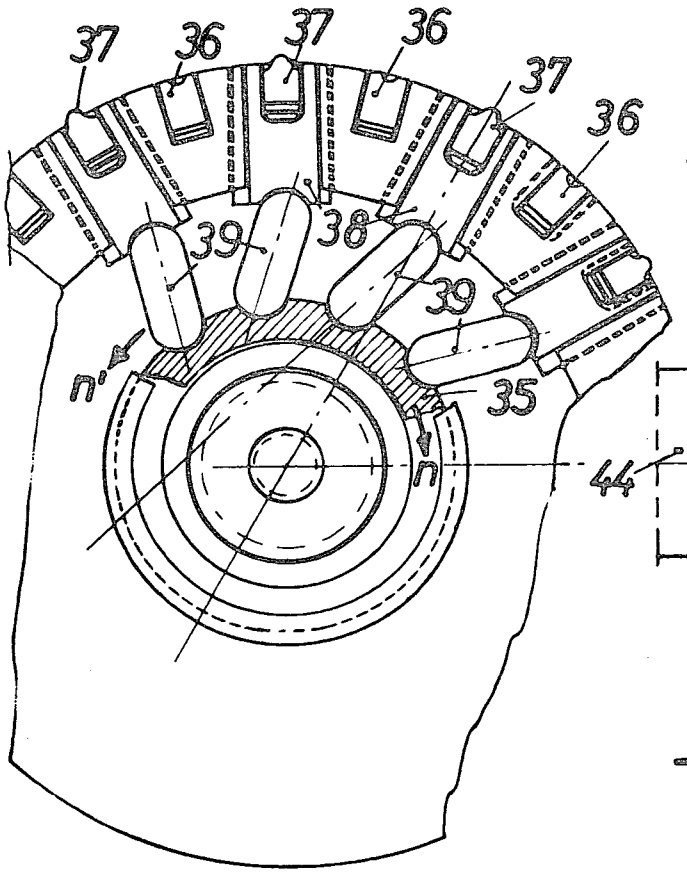
FIG. 14 is a front elevation of part of the tool carrier wheel of FIG. 13.

FIGS. 13 and 14 show a partial view and a partial cross-section through a tool carrier wheel 4. Band 1 is guided by the elastically positioned downholder disc 31. Down-holder disc 31 rests on the elastic ring 32 and is connected with the body of the tool carrier wheel 4 via carrying disc 33, bearing 34, and an adjustable bracing sleeve 35. Matrices or die cavities are firmly arranged in tool carrier wheel 4 while the upper dies 37 are fastened in clamping bodies 38 and can be adjusted with them in a radial direction.

The radial adjustment of clamping body 38 is accomplished by means of spreading elements 39 which act in a toggle manner and which rest on a common bracing sleeve 35 which can be rotated against the tool carrier wheel 4 in the opposite directions of arrows *n, n'* and which are moved in a radial direction through the rotation of the bracing sleeve 35 with respect to the tool carrier wheel 4. The rotation of bracing sleeve 35 and its fixation in every required position is brought about by a finger sleeve 411 whose fingers 42 engage corresponding axial grooves 43 of the bracing sleeve 35. As a result of the axial shift of the shaft 44 which is provided with a coarse thread 45 and which rotates with the tool carrier wheel 4, the finger sleeve 411, which is firmly connected with shaft 44, is likewise shifted in an axial direction and is turned with respect to the tool carrier wheel 4. This turn is communicated to the bracing sleeve 35 via fingers 42 and, through spreading elements 39, brings about the radial shift of the clamping bodies 38 and thus of the upper dies 37.

Via a clutch coupling disc 46 which is firmly connected with the bracing sleeve 35 and which is secured, for example, by means of a snap ring 40, it is possible to couple the freely rotatable carrying disc 33, on which the downholder disc 31 is positioned elastically, firmly to the rotation movement of the tool carrier wheel 4 by means of remote-controlled coupling clutch pins 47. The coupling pins 47, for example, can be pushed forward by means of an electromagnetic, hydraulic, or pneumatic device 48, into corresponding boreholes 49 of carrying disc 33 or they can be withdrawn from these holes.

Figures 15, 16:
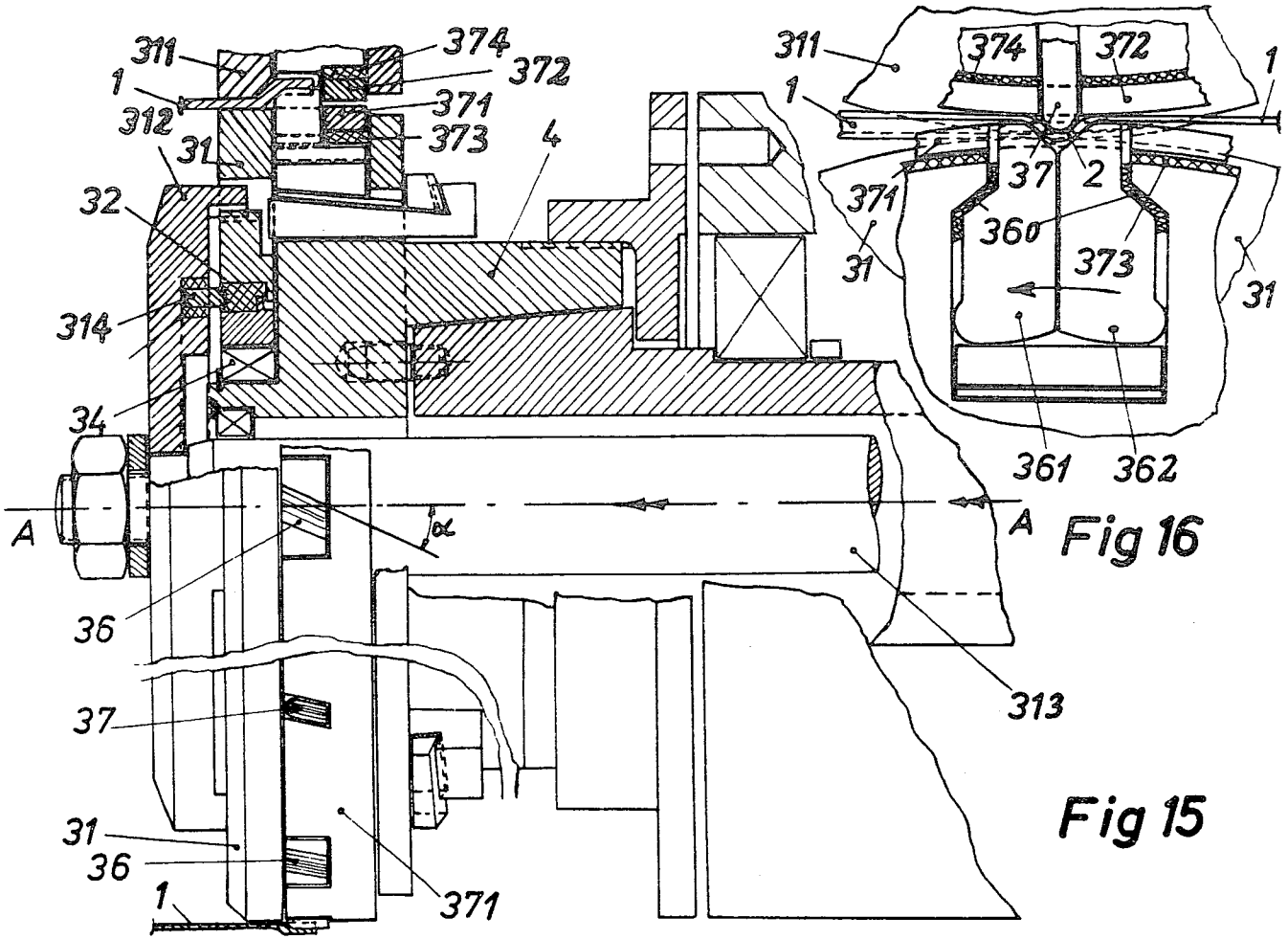
FIG. 15 is an elevational view partly in section showing a tool carrier wheel 4 with upper dies, and matrixes located in a slant (diagonally) with respect to the rotation axis as well as elastically embedded downholder rings 371, 372 in the running plane of the matrixes and upper dies.
FIG. 16 is a fragmentary elevation showing a divided matrix 361, 362 with elastic supporting medium 360.

In FIG. 15 the matrices 36 and upper dies 37 which are arranged at angle $\alpha$ diagonally with respect to their rotation axis AA, are shown.

The downholder discs 31, 311, each of which is elastically positioned on an elastic ring 32, can be turned with respect to the tool carrier wheel 4 via bearing 34. The discs are each separately driven by means of drive shaft 313 via a drive disc 312 which rotates with respect to tool carrier wheel 4 and their circumferential speed corresponds to the band passage speed. By means of a minor axial adjustment of drive disc 312 via drive shaft 313, a ring 314, which is elastically embedded in the drive disc 312, is pressed into the elastic supporting ring 32 of downholder disc 31, as a result of which the spring suspension properties of the elastic ring 32 are changed. The pressure of downholder disc 31, 311 on band 1 can thus be changed within broad limits without any change in the adjustment of tool carrier wheels 4, 41.

In the running plane of matrices 36 and upper dies 37, are shown the downholder rings 371, 372, which rest on elastic beds 373, 374, through which pass the matrices 36 and upper dies 37 which are positioned in tool carrier wheels 4, 41. An increase in the press-on pressure of tool carrier wheels 4, 41 causes the upper dies to emerge out of the plane of the downwholder rings 371, 372 because the latter are pressed into their elastic bed 373, 374, as a result of which correspondingly deeper edge deformations 2, 3 develop.

In accordance with FIG. 16, the edge deformations 2 and 3 are formed by divided, elastically braced matrices comprising the two parts 361, 362. The matrix parts 361, 362 adjust to the differing thicknesses *h* of band 1 by means of elastic opening against the pressure of an elastic support medium 360.

Figure 17:
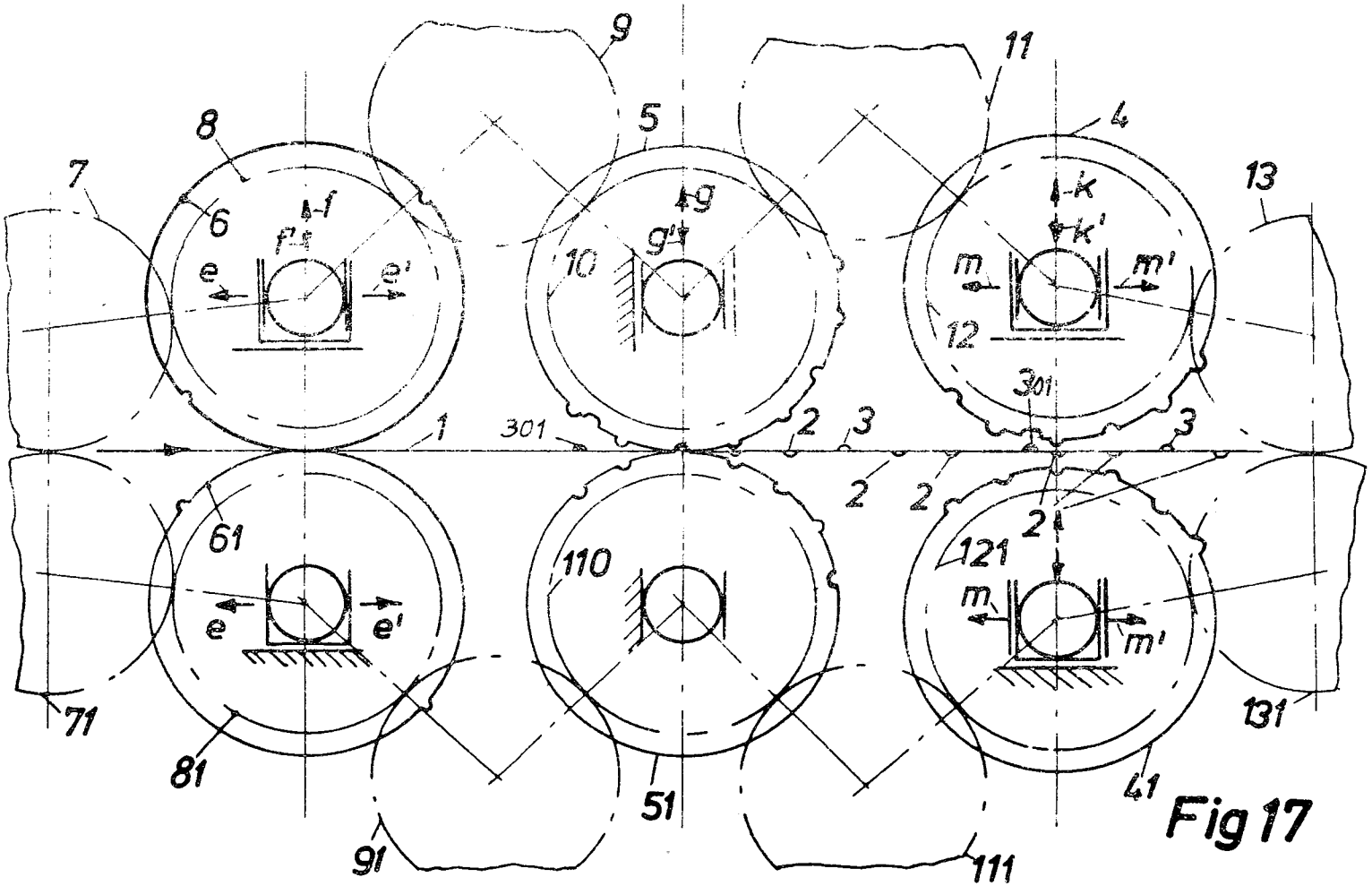
FIG. 17 is a diagram showing one embodiment of the tool for the production of edge deformations 2, 3, 301.

According to FIG. 17, the edge deformations 2 and 3 are produced by the tool carrier wheel pairs 4, 41 and 5, 51, which rotate synchronously with respect to each other, and which, from winding to winding, work alternately in a working and resting position. This change in the position is produced by an adjustment movement in the direction of arrows *k, k'*, respectively, *g, g'*.

For any desired turn or winding, for example, the tool carrier wheel pair 5,51, is in working position, while the tool carrier wheel pair 4, 41 is open, as shown in FIG. 17.

After a revolution of the winch shaft 14 of FIG. 18 (during which the band 1 was moved by the pair of tool wheels a distance corresponding to the length of the winding piled up on the winch shaft and in the process received the edge deformations due to the tool carrier pair 5, 51 according to the sample in FIG. 4) the command for opening the tool carrier wheel pair 5, 51 is given by a signal tooth, finger or cam 19 in FIG. 18 which revolves with the winch shaft 14 and, with some time delay, the command is given them for closing the tool carrier wheel pair 4, 41.

This time delay for the command to close the tool carrier wheel pair 4, 41 depends on the axial interval of the two tool carrier wheel pairs 5, 51 and 4, 41 and on the band speed, in other words, the transportation time for band 1 between the tool carrier wheel pairs 5, 51 and 4, 41.

After another revolution of the winch shaft 14 in FIG. 18 (during which another turn of the coil was formed by a length of band with edges deformed by the tool carrier wheel pair 4, 41 in the edge area according to the sample in FIG. 4) the tool carrier wheel pair 5, 51 gets the command for closing and, a short time thereafter, corresponding to the transportation time it takes for the band to move from tool carrier wheel pair 5, 51 to the tool carrier wheel pair 4, 41, the tool carrier pair 4, 41 is opened.

In the two carrier wheel pairs 4, 41 and 5, 51, for example, there are provided edge deformation matrices and upper dies at two mutually opposite circumferential points, and in the matrices for upper dies there develop only two edge deformations 2, oriented toward the lower band surface, at a mutual interval amounting to the length 2a in FIG. 7. By means of another tool carrier wheel pair 6, 61 (which can be adjusted in the direction of arrows *f, f'*, and which, looking in the direction of band movement, can be arranged not only in front of but also behind the tool carrier wheel pairs 4, 41 and 5, 51) edge deformations 301, FIG. 10, are produced at the points recessed, or to be recessed, according to FIG. 7, in the tool carrier wheel pairs 4, 41, respectively, 5, 51, oriented only toward the upper band surface, and the interval *b* (FIG. 7) of these deformations from the preceding edge deformation to the edge deformation 2 which is oriented toward the lower band surface is smaller than half of the interval of the two edge deformations 2 which are oriented toward the lower band surface, said interval amounting to half of *2a*.

This unsymmetrically arranged edge deformation 301, oriented toward the upper band surface, in the preceding winding, according to FIGS. 7 and 10, forms the abutment for the forward edge deformation 2, oriented toward the lower band surface, of the following winding and brings about a point-shaped, formlocking, thrust-proof connection of neighboring windings against windup direction *d*.

By adjusting the tool carrier wheel pair 4, 41 in the direction of arrows *m, m'*, respectively, and by adjusting the tool carrier wheel pair 6, 61 in the direction of arrows *e, e'*, one can change their interval with respect to the tool carrier wheel pair 5, 51.

For the practical accomplishment of the winding action it is not necessary to coordinate the opening and closing of tool carrier wheel pairs 4, 41 and 5, 51 so accurately that successive windings, whose edge deformations 2, 3 were produced alternatingly by the tool carrier wheel pairs 4, 41, and 5, 51 respectively, can be assembled, one above the other, without overlap. Instead, a minor overlap, i.e. a minor error in terms of winding length in the following winding, is permissible.

According to FIG. 18, which illustrates an overall view of a coil tool opening system, the command for closing or opening the particular tool carrier wheel pair 4, 41, respectively, 5, 51, with the required differences in the transportation time of the band from tool carrier wheel pairs 5, 51 to tool carrier wheel pair 4, 41, respectively, for the performance of a short-time superposition of the rotary movement of tool carrier wheels 4, 41 in FIG. 11 by an angle $\beta$, according to FIG. 12, is triggered by a signal tooth 19 rotating with the winch shaft 14, for example, in the form of a single tooth gear wheel. At every revolution, a countertooth-wheel 20 is turned by one tooth subdivision, as a result of which, for example, corresponding valves (not illustrated) in a hydraulic system are controlled for the activation of corresponding adjusting cylinders 15, 16 for the tool carrier wheel pairs 4, 41 and 5, 51. Another similar control involving rotation of the tooth wheel 29 in FIG. 12 is not completely illustrated in that figure.

The superposition of the rotary movement of tool carrier wheels 4, 41 in FIG. 11 by an angle $\beta$ per revolution of the winch shaft 14 in FIG. 18 can also take place continually during every revolution of the winch shaft 14.

For example, by means of a so-called electrical shaft, one can turn the shaft of a gear, not shown, synchronously with the winch shaft 14, and by means of a variable translation between the shaft of this gear and the shaft of tooth wheel 29 in FIG. 12, one can bring about any desired rotation angle $\beta$ which will grow continually with every revolution of the winch shaft 14 in FIG. 18.

In order to get a form-locking thrust composite both in the windup direction and in the opposite direction, for a large band thickness range and every possible winding interval, it is necessary to make sure, in accordance with FIGS. 4 and 7, that there will be closest contact between edge deformations 3 or 301, and the abutting deformations which are oriented toward the lower band surface, in terms of neighboring windings.

To make sure that neighboring windings will not be shoved in the windup direction, the following procedure is used according to FIG. 4: to transmit the forces $F_1$, the tool carrier wheel pairs 4, 41 and 5, 51 perform identical edge deformations 2, 3. The mutual interval between the tool carrier wheel pairs can be so changed by shifting the tool carrier wheel pair 4, 41 in the direction of arrows *m*, respectively, *m'*, in FIGS. 17, 18, during band movement in a continual manner, that, according to FIG. 4, a part of the particular edge deformations 2 of the oncoming band winding will be placed closely in front of the particular edge deformations 3 of the preceding band winding. This point-shaped, form-locking thrust composite is achieved very frequently through the combination of edge deformations 2 with 3, respectively, 301 with 2 from the first to the last band winding. In this process, sufficiently firmly wound-up band rings 22 develop on winch 14 for the reel-up and the subsequent unreeling process.

In the case of coils, which are stored with a horizontal windup [reelup] axis, the thrust composite of neighboring windings, which acts in a force-locking manner due to the friction of the individual border deformations, is considerably enlarged opposite to the windup direction due to the border deformations which become effective in a point-shaped, force-locking manner.

The edge deformations 201, which are scattered in between the border deformations to secure the windings against being shoved in the windup direction *d* as indicated in FIG. 10, are achieved through the pairing of the tool carrier wheel pairs 4, 41 with 6, 61, and the tool carrier wheel pairs 5, 51 and 6, 61 in the following manner:

On the circumferences of the tool carrier wheel pairs 4, 41, respectively, 5, 51, in FIG. 17, the matrices, respectively, upper dies, are recessed in some places, that is, those matrices and upper dies with which the edge deformations 3, oriented toward the upper band surface, are produced. In the area of these places, the tool carrier wheel pair 6, 61 produces an edge deformation 301 which is oriented toward the upper band surface and whose interval *b* from the edge deformation 2, oriented toward the lower band surface, is smaller than a, FIGS. 4 and 7. This shift in the edge deformation 301, as compared to the edge deformations 3, brings about the placement of corresponding edge deformations against their opposite flanks, as illustrated in FIG. 7. This combination of edge deformations of neighboring windings produces a form-locking thrust composite of forces $F_2$ against the windup direction *d* of FIG. 10. As a result of a horizontal shift of tool carrier wheel pair 6, 61, in the arrow directions 3, or *e'*, in FIGS. 17 and 18, the intervals between tool carrier wheel pair 6, 61 and the tool carrier wheel pairs 4, 41 and 5, 51 and thus the position of the edge deformation 301 with respect to the edge deformation 2, this is, the interval *b*, can continually be changed during band movement in such a fashion that the edge deformations 301 of the particular preceding winding and the edge deformations 2 of the oncoming winding will come to lie closely next to each other in the manner illustrated in FIG. 7.

The change in the depth of the individual edge deformations 2, 3, 301 can be achieved by changing the axial intervals of the corresponding tool carrier wheels 4, 41; 5, 51; 6, 61 in the direction of arrows *k, k'; g, g,'; f, f'* in FIGS. 17 and 18, while tooth wheels 7, 71; 8, 81, 9, 91; 10, 110; 11, 111; 12 121; 13, 131 take care of the necessary synchronization of the corresponding tool carrier wheels 4, 41; 5, 51; 6, 61 as well as the particular corresponding tool carrier wheel pairs 4, 41/6, 61; 5, 51/6, 61.

In order to be able to provide unbordered bands, having width fluctuations, with edge deformations in such a manner that their spacing from their band edges will not change, it is proposed that the axes of the tool carrier wheels be swung on both sides of the band independently of each other by a small angle in the band plane, so that the tool carrier wheels will be able to follow the width change of the band on both sides independently of each other without generation of a force which would arch or tighten the band in a lateral direction.

Figure 19:
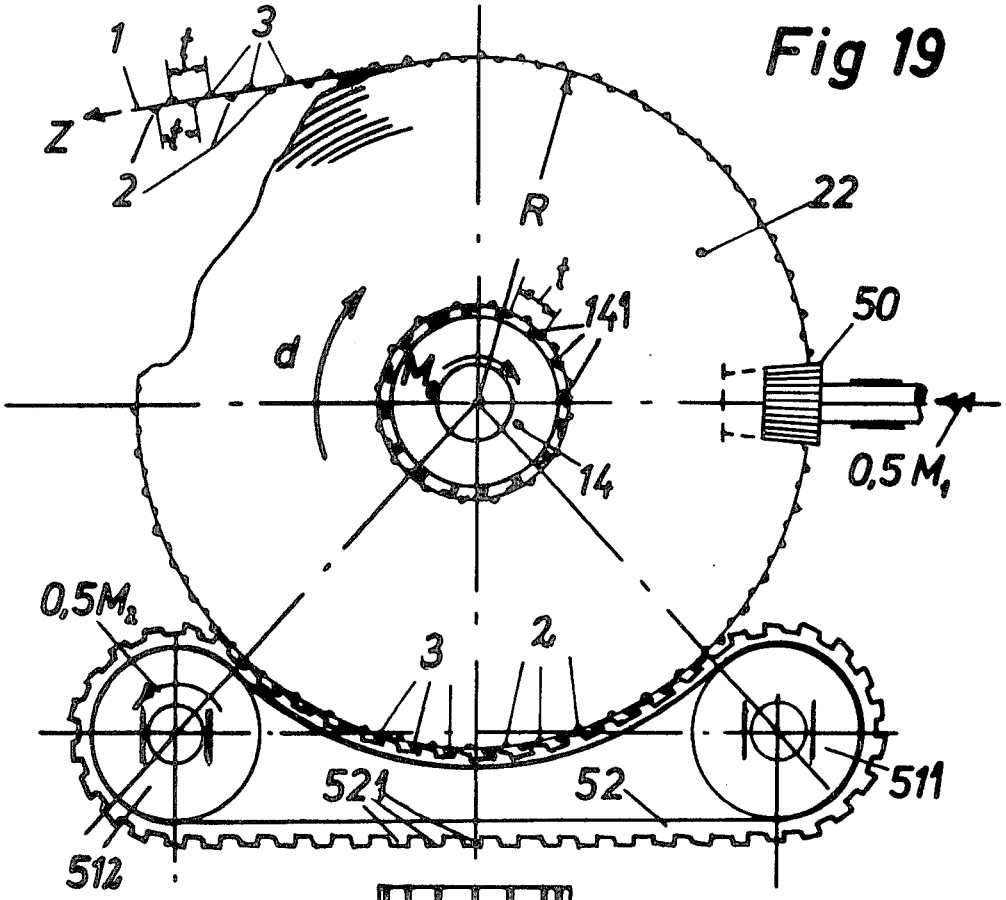
FIG. 19 is an elevational diagram showing two possibilities for the band edge drive.
Figure 20:
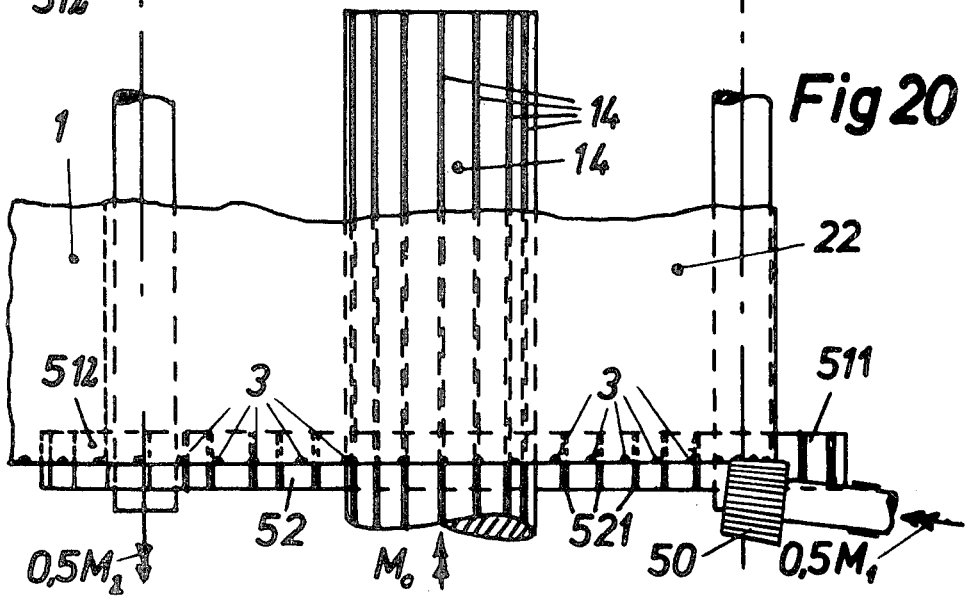
FIG. 20 is a top view of FIG. 19.

According to FIG. 19, which is a side view of a coil 22, and FIG. 20, which shows a top view on FIG. 19, several possibilities are conceivable to cover or relieve the band winding moment $M=Z \cdot R$, especially when the start of the band was placed around the winch shaft with the help of a belt winder without clamping in a winch clamping slip.

The novel carrier bars 141 of the winch shaft 14 are shifted radially so far into the winding position (by way of adaptation to the band thickness) that the circumference of the median plane of the first winding, placed around by means of the belt winder, will as accurately as possible amount to a whole multiple of the subdivision interval *t* of the edge deformations 2 which are to be oriented toward the winch shaft 14. In such instance, the carrier bars 141 are hooked up in a form-locking manner with the edge formation 2 of band 1 so that the circumferential force of winch shaft 14, corresponding to the band windup moment $M_o$ of the winch shaft 14, will with a great degree of certainty be brought into the first band winding via the edge deformations 2 in a form-locking arrangement.

As the band ring diameter 2 R grows and as the band winding traction forces Z increase, the winch shaft moment $M_o$ can be relieved through band edge drive. By means of a driven, revolving tooth chain 52, whose subdivision of teeth 521 corresponds to the subdivision *t* of the corresponding band edge deformations 3, the drive moment 0.5 $M_2$ is imparted to every winding of coil 22 at the band edge primarily in a form-locking arrangement between teeth 521 and the corresponding band edge deformations 3. The chain wheels 511 and 512 here (as the diameter of the coil 22 grows) change their position in such a way that the teeth 521 of the driven tooth chain 52 constantly remain in contact with the corresponding edge deformations 3 of band 1 in the coil 22.

Another possibility for supporting the winch shaft moment $M_o$ is offered through a force-locking band edge drive via a friction wheel 50 with cylindrical, conical, or spherical surface. The drive moment 0.5 $M_1$ is here imparted into the two band edge areas.

By adjustment of the positions of friction wheels 50 to the growing diameter of coil 22, it is made certain that the wheels will always act within the most favorable outer composite sector. The band edge drives through tooth chain 52 with teeth 521 or through friction wheel 50 can be used simultaneously.

Figure 21:
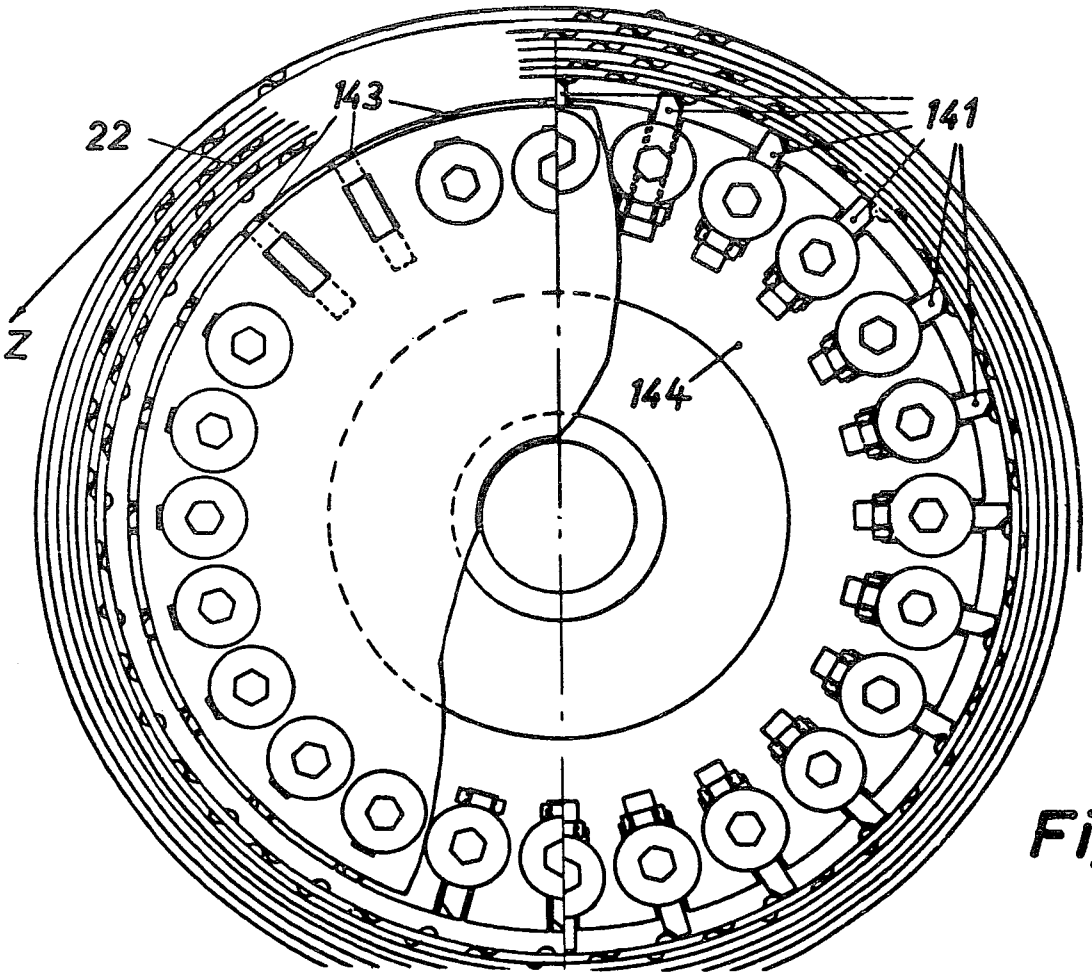
FIG. 21 is a cross section through a reel-up winch with winch surface acting in form-locking manner in the shape of spreadable carrying bars (left half not spread, right half spread)
Figure 22:
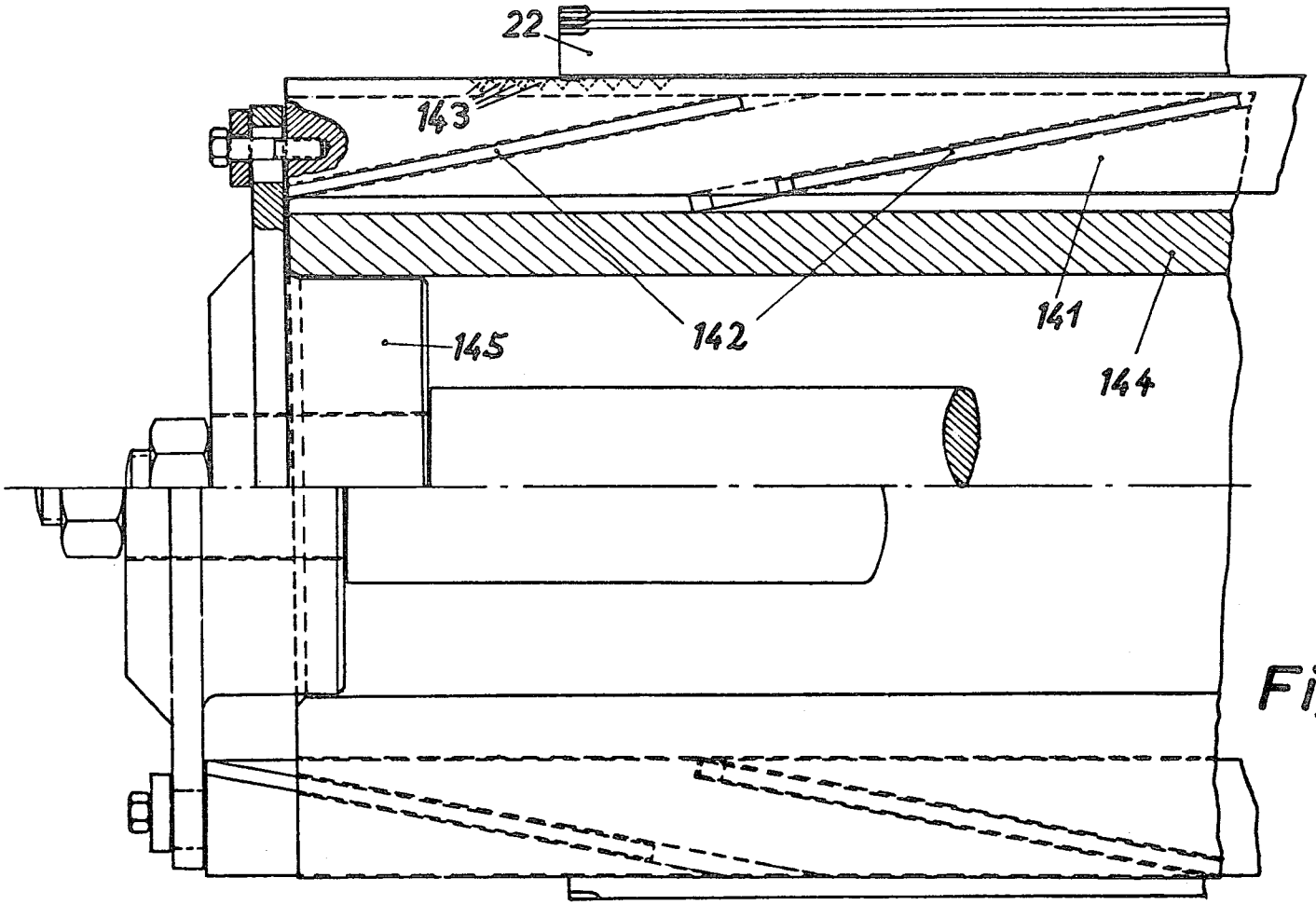
FIG. 22 is a cross-section through FIG. 21 (upper half with spread carrying bars, lower half not spread)

FIG. 21 is a lateral cross-section and FIG. 22 is a longitudinal cross-section through a winch shaft 14 with opened coil 22. In the right half is shown the carrying bars 141, which carry the opened coil 22, in their spreadout position, whereas in the left half, these bars are shown in their retracted position.

Carrying bars 141 are supported by several short and steep wedge-shaped surfaces 142.

In order to prevent the first winding from slipping the axial direction, carrying bars 141 are provided with saw-tooth-like recesses 143 on their front side at least in the band width range. The actual carrying shaft 144 of the winch 14 is a thick-wall pipe with central-symmetrical carrying properties.

Figure 23:
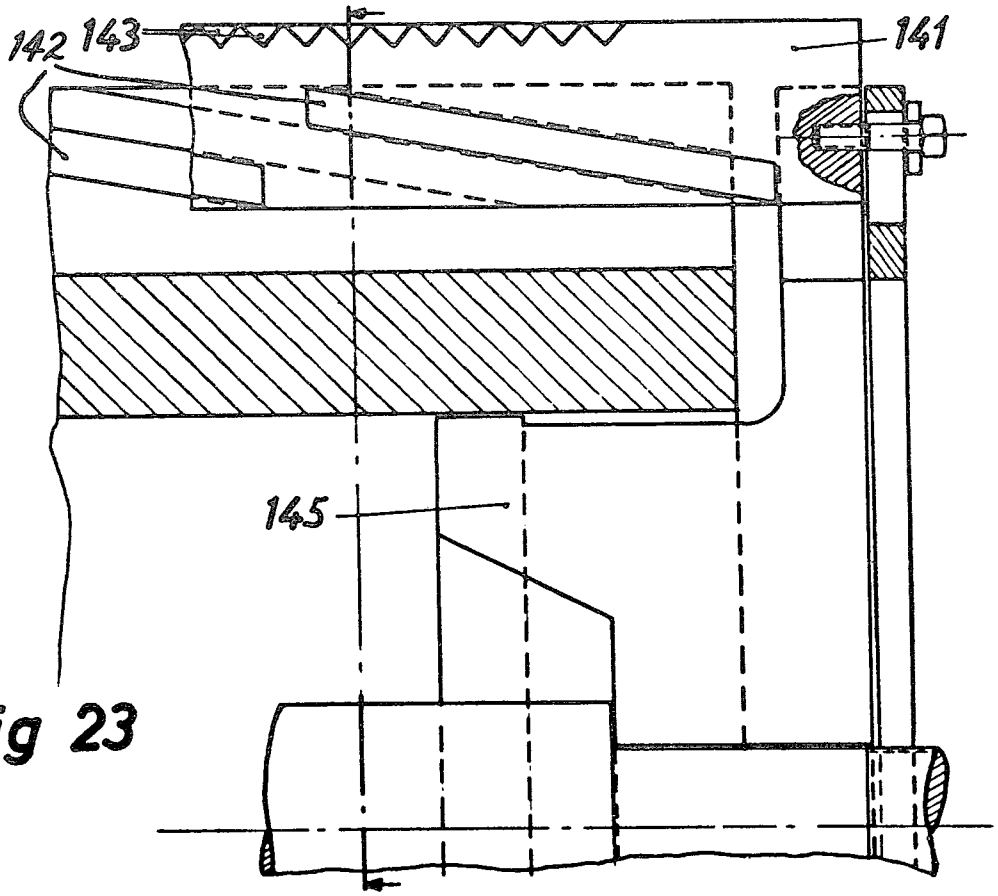
FIG. 23 is a cross-section through a part of the reel-up winch showing one spread carrying bar.

According to FIGS. 22 and 23, the carrying bars 141 are adjusted together by means of the axial shift of a winch front disc 145.

Figure 24:
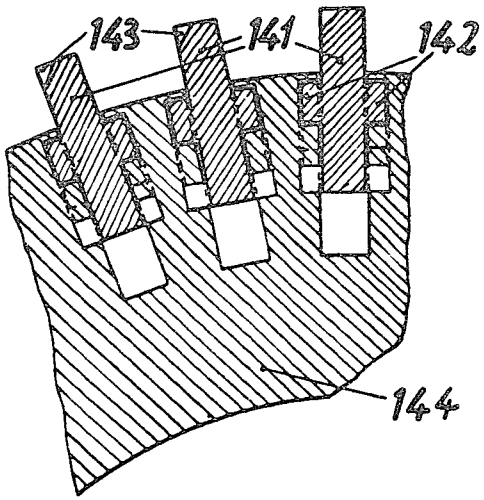
FIG. 24 is a cross-section through FIG. 23.

FIG. 24 represents a partial cross-section through FIG. 23, with carrier bars 141 and their sawtooth-like recesses 143.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

We claim:

1. Method for making a spiral coil comprising the steps of;

(a) moving a band horizontally toward a horizontal winding mandrel for winding a coil, (b) continuously forming in advance of said mandrel a succession of regularly spaced deformations in the band edges, said deformations alternately protruding from the opposite band surfaces and determining the spacing of adjacent turns of the coil, and (c) progressively shifting said succession of deformations along the band for each successive turn of the coil by a predetermined dimension such that all oppositely protruding deformations between adjacent turns come into tangential interlocking engagement with each other, such predetermined dimension of shift taking into account the increase in turn length due to band thickness and coil spacing and the spacing between deformations.

2. Method according to claim 1 wherein said predetermined dimension of step (c) is equal to the space between a downwardly protruding deformation and the next upwardly protruding deformation plus the increase in coil circumference due to band thickness and deformation depth when the shifting of said succession of deformations is in the winding direction.

3. Method according to claim 1 wherein said predetermined dimension of step (c) is equal to the space between a downwardly projecting deformation and the next upwardly projecting deformation minus the increase in coil circumference due to band thickness and deformation depth when the shift of said succession of deformations is in the direction opposite the winding direction.

4. Method according to claim 1, wherein said deformations of step (b) are formed by a rotating tool, and said shifting of deformations, step (c), is generated by a continual amount of tool rotation per turn of the band on the winding mandrel.

5. Method according to claim 1, wherein the total shift of deformation, to be associated with a particular oncoming winding turn, is generated by a corresponding change in the amount of tool rotation in one step.

6. Method according to claim 1, wherein the number of band edge deformations oriented toward the upper and lower band surface are unequal, and wherein the reciprocal spacings between these deformations are equal.

7. Method according to claim 1, wherein the number of band edge deformations oriented toward the upper and lower band surface are unequal, and wherein the reciprocal spacings between these deformations are unequal.

8. Method according to claim 1, wherein at least some of the band edge deformations are arranged diagonally with respect to their band edges, said diagonal deformations at one band edge being opposed to those at the other band edge to yield an arrow-shaped arrangement so as to lock adjacent turns both in the direction of winding and the direction of the coil windup axis.

9. Method according to claim 1, wherein additionally fine-toothed grooves are produced to lock adjacent turns in the direction of the coil axis, said grooves lying in the longitudinal direction of the band close to the band edges.

10. Method according to claim 1, wherein additionally fine-toothed grooves are produced to lock adjacent turns in the direction of the coil axis, said grooves lying in the longitudinal direction of the band and close to and diagonally to the band edges.

11. Method according to claim 5, wherein after completion of the shift of the sequence of band edge deformations in one step, after the pileup of half a turn in each turn, an additional change of the tool rotation speed is performed for a short time and then returned to normal speed, in order to achieve the form-locking hook-up of neighboring turns at some point contrary to the windup direction.

12. Method according to claim 11, wherein said additional short-time change of rotation speed and its return to normal is performed at any desired point in the turn.

13. Method according to claim 1, wherein said deformations of step (b) are formed by two identical tool carrier wheel pairs arranged one behind the other in the band direction, said tool carrier wheel pairs being operative alternately from turn to turn of the band and being run mutually synchronously with the band passage speed, and said tool carrier wheel pairs having a mutual axial spacings which is continually changeable.

14. Method according to claim 1, wherein said shifting of deformations, step (c), is always performed at the same angle position of the coil for each turn.

15. Method according to claim 1, wherein said shifting of deformations, step (c) is performed at several different angular positions in the coil in order to distribute the overlap sections of the band material of neighboring turns so as to prevent inadequate form-locking thrust safety.

16. Method according to claim 1, wherein the number of band edge deformations, oriented toward the upper and the lower band surface, and their mutual spacings are equal.

17. Method according to claim 1, wherein the winding spacings of the band turns are changed as a function of the coil windup radius.

18. Method according to claim 1, wherein said step (c), the shift of the sequence of band edge deformations in or against the band movement direction in the band material, is generated for at least the last turn in a magnitude which, in combination with the greater curvature imparted to this winding shortly before reel-up, corresponds to its position in the reeled-up composite and which, with its resultant elastic clamping of the compound, ensures the locking hook-up of its corresponding band edge deformations with those of the particular preceding turn against the windup direction (sic).

19. Method according to claim 13, wherein the shift of the sequence of the succession of band edge deformations takes place at the end of every piled-up turn by closing of the open tool carrier wheel pair and the opening of the tool carrier wheel pair which happens to be in working position, consideration being given to the alternating direction represented by the band passage direction from the rear to the front tool carrier wheel pair and vice versa, as well as the band speed in the time sequence of the adjustment commands for both tool carrier wheel pairs, and wherein the reciprocal position of corresponding edge deformations in neighboring turns is continually changed during operation by changing the reciprocal interval of the tool carrier wheel pairs.

* * * * *